US011739424B2

(12) United States Patent
Duan et al.

(10) Patent No.: US 11,739,424 B2
(45) Date of Patent: Aug. 29, 2023

(54) GRAPHENE REINFORCED ALUMINUM MATRIX COMPOSITE WITH HIGH ELECTRICAL CONDUCTIVITY AND PREPARATION METHOD THEREOF

(71) Applicant: Wuhan Research Institute of Materials Protection, Wuhan (CN)

(72) Inventors: Haitao Duan, Wuhan (CN); Yinhua Li, Wuhan (CN); Jiesong Tu, Wuhan (CN); Jian Li, Wuhan (CN); Xingeng Li, Wuhan (CN); Zhibin Fan, Wuhan (CN); Dan Jia, Wuhan (CN); Shengpeng Zhan, Wuhan (CN); Tian Yang, Wuhan (CN); Yunhu Ding, Wuhan (CN); Lixin Ma, Wuhan (CN)

(73) Assignee: WUHAN RESEARCH INSTITUTE OF MATERIALS PROTECTION, Wuhan (CN)

( * ) Notice: Subject to any disclaimer, the term of this patent is extended or adjusted under 35 U.S.C. 154(b) by 0 days.

(21) Appl. No.: 17/843,235

(22) Filed: Jun. 17, 2022

(65) Prior Publication Data

US 2023/0086290 A1 Mar. 23, 2023

(30) Foreign Application Priority Data

Aug. 11, 2021 (CN) ..... 202110917018.8

(51) Int. Cl.
*C23C 18/31* (2006.01)
*C23C 18/16* (2006.01)

(52) U.S. Cl.
CPC ..... *C23C 18/31* (2013.01); *C23C 18/1639* (2013.01); *C23C 18/1691* (2013.01); *C23C 18/1692* (2013.01)

(58) Field of Classification Search
None
See application file for complete search history.

(56) References Cited

U.S. PATENT DOCUMENTS

2023/0086290 A1* 3/2023 Duan ..... C23C 18/1691

FOREIGN PATENT DOCUMENTS

| | | |
|---|---|---|
| CN | 109402442 A | 3/2019 |
| CN | 111101013 A | 5/2020 |

* cited by examiner

*Primary Examiner* — Scott R Kastler
(74) *Attorney, Agent, or Firm* — WPAT, PC

(57) ABSTRACT

A graphene reinforced aluminum matrix composite with high electrical conductivity and a preparation method thereof. The method includes: obtaining aluminum coated graphene powder by plating aluminum on a graphene surface, melting aluminum block into aluminum liquid, heating a mold to be lower than an aluminum melting point, alternately pouring the aluminum liquid and the aluminum coated graphene powder into the mold for layered casting to obtain a sandwich structure; extruding the sandwich structure into a rectangular test block and then heating to 500~600° C., performing heat preservation for a preset time and performing forging treatment, and performing longitudinal cold deformation under inert gas to obtain the graphene reinforced aluminum matrix composite. The method can solve a problem that poor wettability of graphene and aluminum matrix, the graphene is evenly dispersed in the aluminum matrix, which can improve strength of the aluminum matrix and keep its high electrical conductivity.

9 Claims, No Drawings

GRAPHENE REINFORCED ALUMINUM MATRIX COMPOSITE WITH HIGH ELECTRICAL CONDUCTIVITY AND PREPARATION METHOD THEREOF

TECHNICAL FIELD

The disclosure belongs to the technical field of aluminum alloy smelting and rolling in a metallurgical industry, and relates to a preparation method for improving the electrical conductivity and strength of an aluminum material, in particular to a graphene reinforced aluminum matrix composite and a preparation method thereof, focusing on solving a problem that the electrical conductivity of the aluminum material gradually decreases with the increase of the strength.

DESCRIPTION OF RELATED ART

Pure aluminum (Al) has attracted much attention because of its low density, low melting point, strong corrosion resistance, good thermal and electrical conductivity, and other performance advantages. An aluminum alloy material derived from the pure aluminum has good plasticity and can be processed into various profiles. It is widely used in industry, and its usage is only second to that of steel. It has become an indispensable alloy system in the material field. With the development of economy and the progress of society, the technical expectation of aluminum matrix materials is becoming higher and higher. For example, in a rapidly developing field of electric power and aerospace, the aluminum matrix materials, as a light conductor material, hope to improve the strength while maintaining the high electrical conductivity. Alloying elements have a significant effect on improving mechanical properties of aluminum matrix, but at the same time, will lead to a sharp decline in electrical conductivity.

Since the successful preparation of carbon materials, the basic research and engineering application research related to the carbon materials have also become a research hotspot in recent years. The carbon materials with different morphologies and structures have their unique mechanical, electrical, chemical, and optical properties, which have attracted great attention in the material industry. An electron mobility of graphene exceeds 1.5 $m^2/V\cdot s$, which is much higher than that of copper (0.0032 $m^2/V\cdot s$) and aluminum (0.0015 $m^2/V\cdot s$). Graphene has more outstanding advantages in improving the electrical conductivity of aluminum matrix composites. However, the graphene and aluminum matrix materials have poor wettability and weak adhesion, so it is difficult to disperse the graphene evenly. How to evenly disperse graphene into aluminum matrix to effectively improve the strength of aluminum matrix while maintaining high electrical conductivity of aluminum matrix. It is an urgent technical problem to be solved.

Through search: Chinese patent publication No. CN111101013A, which discloses a preparation method of a new graphene-aluminum composite material and graphene-aluminum composite material. The method includes forming an aluminum film on graphene powder by magnetron sputtering to obtain modified graphene powder; adding the modified graphene powder into molten aluminum liquid and stirring to make the modified graphene powder evenly dispersed in the aluminum liquid to obtain a mixed system; and curing the mixed system. This method uses the magnetron sputtering to coat the graphene powder, the process is complicated, the operation is difficult, and the cost is high.

Chinese patent publication No. CN109402442A provides a die-casting method for preparing graphene reinforced aluminum matrix composites. The method is to adopt a semi-solid die-casting method to melt, heat preservation, electromagnetic stirring, compaction, and die-casting into the graphene reinforced aluminum matrix composite. A hardness of the prepared composite is 85 HB, a tensile strength of the prepared composite is 245 MPa, and an elongation of the prepared composite is 8%. The semi-solid aluminum alloy ingot prepared by this method contains silicon (Si) element, which will seriously reduce the electrical conductivity of the aluminum matrix. Therefore, this patent document does not mention the electrical conductivity of the composite. At the same time, in this method, the size of cut aluminum particles is ≤1 mm, which is large, and the cut aluminum particles with the graphene forming the composite has little effect on improving the wettability.

SUMMARY OF THE DISCLOSURE

The disclosure aims to provide a graphene reinforced aluminum matrix composite with high electrical conductivity and a preparation method thereof, focusing on solving the problem that the electrical conductivity of the aluminum alloy gradually decreases with the increase of the strength.

In order to solve the above problem, the technical schemes adopted by the disclosure are as follows.

A preparation method of a graphene reinforced aluminum matrix composite with high electrical conductivity, includes:

- step 1, preparation of raw materials: drying graphene, aluminum powder and aluminum block in a drying oven to remove moisture;
- step 2, obtaining aluminum coated graphene powder by plating the aluminum powder on a surface of the graphene through an electroless plating method;
- step 3, melting the aluminum block into aluminum liquid in a crucible furnace and injecting inert gas for protection;
- step 4, heating a forming device to a temperature lower than a melting point of aluminum;
- step 5, pouring the aluminum liquid obtained in the step 3 into a mold to form an aluminum liquid solidification layer, then laying a layer of the aluminum coated graphene powder obtained in the step 2 to form an aluminum coated graphene powder layer, then pouring the aluminum liquid to form another aluminum liquid solidification layer, and then laying another layer of the aluminum coated graphene powder to form another aluminum coated graphene powder layer, repeating the above operations until the mold is fully filled, and a last layer being the aluminum liquid solidification layer, thereby forming a sandwich structure (also referred to as laminated structure or stacked structure); i.e., the step 5 includes: alternately pouring the aluminum liquid into the forming mold of the forming device to form an aluminum liquid solidification layer and laying a layer of the aluminum coated graphene powder on the aluminum liquid solidification layer to form an aluminum coated graphene powder layer until the forming mold is fully filled, thereby forming a sandwich structure with a first layer and a last layer both being the aluminum liquid solidification layers;
- step 6, extruding the sandwich structure obtained in the step 5 into a rectangular test block by using a press;
- step 7, heating the rectangular test block to a temperature in a range of 500° C. to 600° C. in a heating furnace and performing heat preservation for a preset time, and performing forging treatment on the rectangular test block to obtain a forged rectangular test block;

step 8, performing longitudinal cold deformation on the forged rectangular test block to obtain a deformed rectangular test block, after cooling the forged rectangular test block to room temperature; and step 9, performing annealing treatment on the deformed rectangular test block under a protection of inert gas to obtain the graphene reinforced aluminum matrix composite with high electrical conductivity.

In an embodiment, in the step 1, a mass fraction of aluminum in each of the aluminum block and the aluminum powder is ≥99.6%.

In an embodiment, in the step 2, after the graphene is coarsened, sensitized and activated, plating the aluminum powder on the surface of the graphene through electroless plating in an aluminum liquid at a room temperature.

In an embodiment, in the step 3, a heating temperature of the crucible furnace is in a range of 700° C. to 800° C.

In an embodiment, the inert gas in the step 3 is one of argon gas and helium gas; and the inert gas in the step 9 is one of argon gas and helium gas.

In an embodiment, in the step 4, a heating temperature of the forming device is in a range of 250° C. to 350° C.

In an embodiment, in the step 5, a number of the aluminum coated graphene powder layer of the sandwich structure is greater than or equal to 2, and content of the aluminum coated graphene powder layers are evenly distributed according to a total design content, a thickness of the aluminum coated graphene powder layer is less than 10 μm, and a thickness of the aluminum liquid solidification layer is less than 3 mm.

In an embodiment, in the step 7, the preset time is in a range of 25 min to 35 min, and a forging direction of the forging treatment is crisscross.

In an embodiment, in the step 8, a deformation amount of the longitudinal cold deformation of the forged rectangular test block is in a range of 40% to 60%.

In an embodiment, in the step 9, a temperature of the annealing treatment is in a range of 200° C. to 300° C., and a time in a furnace is in a range of 30 min to 60 min.

The disclosure further provides a graphene reinforced aluminum matrix composite with high electrical conductivity, prepared by the any one of the above preparation methods. A mass fraction of carbon (C %) in the graphene reinforced aluminum matrix composite is in a range of 1.5 wt % to 2.5 C wt %, and the rest is the aluminum and inevitable impurities. The tensile strength of the composite prepared by the above method reaches 130 MPa and the electrical conductivity of the composite reaches 60% international annealed copper standard (IACS).

The function and control principle of each component and main process in the disclosure:

The dispersion strengthening effect is achieved by evenly dispersing the graphene in the aluminum matrix. At the same time, dispersed particles can act as nucleation particles to refine the grains, which can strengthen the tensile strength of the aluminum matrix without reducing its electrical conductivity.

In the disclosure, the following processes are controlled that:

the graphene is added because it has excellent mechanical properties (Young's modulus is up to 1 TPa, breaking strength is about 130 GPa), thermal properties (thermal conductivity is about 5000 W/m·K) and electrical properties (electron mobility is up to 15000 $cm^2/V \cdot s$, electrical conductivity is about 108 Siemens per meter (S/m));

the reason why the aluminum powder is plated on the surface of the graphene by the electroless plating is that, according to a principle of oxidation-reduction reaction, aluminum ions can be reduced to aluminum metal by the electroless plating in a solution containing the aluminum ions by using a strong reducing agent and deposited on the surface of the graphene to form a dense coating, which has uniform coating, small pinholes and no direct current (DC) power supply equipment. In addition, the discharge of waste liquid of the electroless plating is less, the environmental pollution is small and the cost is low;

the reason why the heating temperature of the forming device is controlled to be in the range of 250° C. to 350° C. is to slow down the solidification and temperature drop after the liquid is poured into the mold, prevent the grain growth, and provide guarantee for the subsequent extrusion forming;

the sandwich structure is made to solve the problem of poor wettability of graphene and aluminum, and a forced mean to mix the graphene and the aluminum is used. The reason why the number of the aluminum coated graphene powder layers is controlled to be greater than or equal to 2, and the thickness of each aluminum coated graphene powder layer is controlled to be less than 10 μm, and the thickness of each aluminum liquid solidification layer is controlled to be less than 3 mm during the casting process is to ensure full contact between the graphene and the aluminum matrix, and provide conditions for subsequent processing;

the reason why the formed sample is heated again but not melted is that the graphene and the aluminum matrix are fully diffused and do not escape; a purpose of the forging is to fully mix the graphene and the aluminum and refine the grain;

the reason why the deformation amount of the longitudinal cold deformation of the rectangular block is controlled to be in the range of 40% to 60% is that the longitudinal cold deformation can make the grains elongate longitudinally and increase the dislocation defects. In the subsequent annealing process, these defects can be used as a "fast channel" for atomic diffusion to improve the electrical conductivity and strength of the material. However, if the deformation amount is too large, the dislocation density increases, and aging is unstable, which is prone to recovery and recrystallization, therefore, the deformation amount shall be controlled to be in the range of 40% to 60%; and the reason why the annealing temperature is controlled to be in the range of 200° C. to 300° C. is that the precipitation force is small when the temperature is less than 200° C., and the strengthening effect is weakened when the temperature is higher than 300° C., and the grains are easy to grow and the strength decreases.

The disclosure has the following technical advantages compared with the prior art:

the aluminum powder is coated on the surface of the graphene by the electroless plating, and then the sandwich structure is formed. The joint action of subsequent heating, forging, etc., which effectively improves the poor wettability of the graphene and the aluminum liquid, ensures the uniform addition of the graphene, and uses the graphene with high carrier mobility and bipolar electric field effect to reduce the effect of insulation channel and improve electrical conductivity; at the same time, combining the dislocation strengthening and precipitation purification of the longitudinal cold deformation with the subsequent annealing process, the high electrical conductivity of the pure aluminum is maintained, and the tensile strength of aluminum matrix is effectively improved. The tensile strength of the composite obtained by the disclosure has reached 130 MPa, the electrical conductivity of the composite has reached 60% IACS, the electrical conductivity of the composite is close to that of the pure aluminum, the strength of the composite is more improved than that of the pure aluminum, and the performance of the composite is better.

DETAILED DESCRIPTION OF EMBODIMENTS

The disclosure is described in detail below:

Table 1 is a list of values of embodiments 1-5 and comparative embodiments 1 and 2.

(7) heating the rectangular test block to 550° C. in a heating furnace and performing heat preservation for 30 min, and performing forging treatment on the rectangular test block for 10 min to obtain a forged rectangular test block;

(8) performing 50% longitudinal cold deformation on the forged rectangular test block to obtain a deformed rectangular test block (i.e., treated sample)

(9) cutting the treated sample into required sizes to obtain cut samples;

(10) obtaining the aluminum matrix composite with high strength, high electrical conductivity and wear resistance by annealing the cut samples at 240° C. for 40 min in a furnace and air cooling to room temperature.

The five embodiments and the two comparative embodiments respectively prepare the graphene reinforced aluminum matrix composites with high electrical conductivity of the disclosure by selecting different material components and processes. The proportions of the components are shown in Table 1.

TABLE 1 chemical components and processes of the embodiments and the comparative embodiments of the disclosure

| embodiment | C/wt % | Al/wt % | the number of aluminum coated graphene powder layer | time of the forging/min | deformation amount of longitudinal cold deformation/% | temperature of the annealing/ ° C. |
|---|---|---|---|---|---|---|
| 1 | 1.50 | Rest | 3 | 15 | 60 | 200 |
| 2 | 1.70 | Rest | 4 | 12 | 56 | 220 |
| 3 | 1.90 | Rest | 5 | 9 | 50 | 250 |
| 4 | 2.00 | Rest | 3 | 10 | 45 | 280 |
| 5 | 2.50 | Rest | 6 | 8 | 42 | 300 |
| Comparative 1 | 0.03 | Rest | 0 | 0 | 60 | 300 |
| Comparative 2 | 2.00 | Rest | 3 | 0 | — | — |

Table 2 is a list of performance tests of the embodiments 1-5 and the comparative embodiments 1 and 2.

Each embodiment of the disclosure is prepared according to the following steps:

(1) drying raw materials in a drying oven for 2 hours to remove moisture, the raw materials include graphene, aluminum powder and aluminum block;

(2) after the graphene is coarsened, sensitized and activated, plating the aluminum powder on a surface of the graphene through electroless plating in aluminum liquid at a room temperature;

(3) heating the aluminum block to be in the range of 700° C. to 800° C. to melt, and injecting inert gas for protection;

(4) heating a forming mold to 300° C.;

(5) alternately pouring the aluminum liquid into the forming mold to form an aluminum liquid solidification layer and laying a layer of the aluminum coated graphene powder on the aluminum liquid solidification layer to form an aluminum coated graphene powder layer until the forming mold is fully filled, thereby forming a sandwich structure with a first layer and a last layer both being the aluminum liquid solidification layers;

(6) extruding the sandwich structure into a rectangular test block in a rectangular mold by using a press, and then cooling the rectangular test block to room temperature;

TABLE 2 list of performance results of the embodiments and the comparative embodiments of the disclosure

| Embodiment | Tensile strength/MPa | Electrical conductivity/% IACS |
|---|---|---|
| 1 | 130 | 61 |
| 2 | 132 | 61 |
| 3 | 140 | 60 |
| 4 | 137 | 60 |
| 5 | 132 | 61 |
| Comparative 1 | 72 | 62 |
| Comparative 2 | 89 | 60 |

It can be seen from Table 2 that the aluminum carbon composites of the five embodiments prepared by the disclosure have the same electrical conductivity as the pure aluminum materials on the premise of improving the strength.

The above embodiments are only used to illustrate the disclosure and not to limit the disclosure. Although the disclosure has been described in detail with reference to the embodiments, those skilled in the art should understand that any combination, amendment, or equivalent replacement of the technical scheme of the disclosure does not deviate from the spirit and scope of the technical scheme of the disclosure, and all should be covered by the claims of the disclosure.

What is claimed is:

1. A preparation method of a graphene reinforced aluminum matrix composite, comprising:

preparation of raw materials, comprising: drying graphene, aluminum powder and aluminum block in a drying oven to remove moisture;

obtaining aluminum coated graphene powder by plating the aluminum powder on a surface of the graphene through electroless plating;

melting the aluminum block into aluminum liquid in a crucible furnace and injecting first inert gas for protection;

heating a forming device to a temperature lower than a melting point of aluminum;

alternately pouring the aluminum liquid into a forming mold of the forming device to form an aluminum liquid solidification layer and laying a layer of the aluminum coated graphene powder on the aluminum liquid solidification layer to form an aluminum coated graphene powder layer until the forming mold is fully filled, thereby forming a sandwich structure with a first layer and a last layer both being the aluminum liquid solidification layers;

extruding the sandwich structure into a rectangular test block by using a press;

heating the rectangular test block to a temperature in a range of 500° C. to 600° C. in a heating furnace, keeping the heated rectangular test block in the heating furnace to maintain the temperature for a preset time, and performing forging treatment on the rectangular test block to obtain a forged rectangular test block;

after cooling the forged rectangular test block to room temperature, performing longitudinal cold deformation on the forged rectangular test block to obtain a deformed rectangular test block; and performing annealing treatment on the deformed rectangular test block under a protection of second inert gas to obtain the graphene reinforced aluminum matrix composite.

2. The preparation method of the graphene reinforced aluminum matrix composite according to claim 1, wherein the plating the aluminum powder on a surface of the graphene through electroless plating, comprises:

coarsening, sensitizing and activating the graphene sequentially, and then plating the aluminum powder on the surface of the graphene through the electroless plating in an aluminum liquid at room temperature.

3. The preparation method of the graphene reinforced aluminum matrix composite according to claim 1, wherein a heating temperature of the crucible furnace is in a range of 700° C. to 800° C.

4. The preparation method of the graphene reinforced aluminum matrix composite according to claim 1, wherein each of the first inert gas and the second inert gas is one of argon gas and helium gas.

5. The preparation method of the graphene reinforced aluminum matrix composite according to claim 1, wherein a heating temperature of the forming device is in a range of 250° C. to 350° C.

6. The preparation method of the graphene reinforced aluminum matrix composite according to claim 1, wherein a number of the aluminum coated graphene powder layer of the sandwich structure is greater than or equal to 2, content of the aluminum coated graphene powder layers are evenly distributed according to a total content, a thickness of the aluminum coated graphene powder layer is less than 10 μm, and a thickness of the aluminum liquid solidification layer is less than 3 mm.

7. The preparation method of the graphene reinforced aluminum matrix composite according to claim 1, wherein the preset time is in a range of 25 min to 35 min, and a forging direction of the forging treatment is crisscross.

8. The preparation method of the graphene reinforced aluminum matrix composite according to claim 1, wherein a deformation amount of the longitudinal cold deformation of the forged rectangular test block is in a range of 40% to 60%.

9. The preparation method of the graphene reinforced aluminum matrix composite according to claim 1, wherein a temperature of the annealing treatment is in a range of 200° C. to 300° C., and a time in a furnace during the annealing treatment is in a range of 30 min to 60 min.

* * * * *